United States Patent [19]

Reeves, Jr. et al.

[11] 4,355,438

[45] Oct. 26, 1982

[54] MAT FORMING APPARATUS

[75] Inventors: James E. Reeves, Jr., Anderson, S.C.; Michael P. Dunn, Newark; John L. Patterson, Granville, both of Ohio

[73] Assignee: Owens-Corning Fiberglas Corporation, Toledo, Ohio

[21] Appl. No.: 235,263

[22] Filed: Feb. 17, 1981

[51] Int. Cl.[3] ..... D04H 1/00

[52] U.S. Cl. ..... 19/0.51; 19/0.6; 19/305; 83/913

[58] Field of Search ..... 19/0.51, 0.6, 300, 304, 19/305, 296, 148; 65/12; 83/23, 913; 425/83

[56] References Cited

U.S. PATENT DOCUMENTS

| | | | |
|---|---|---|---|
| 2,719,336 | 10/1955 | Stotler | 19/0.6 X |
| 2,729,028 | 1/1956 | Slayter et al. | 19/305 X |
| 3,025,197 | 3/1962 | Sheidley | 19/305 X |
| 3,124,844 | 3/1964 | Constantine et al. | 19/0.51 |
| 4,106,163 | 8/1978 | Desverchére | 19/296 |
| 4,175,939 | 11/1979 | Nakazawa et al. | 83/913 X |

*Primary Examiner*—Louis Rimrodt

*Attorney, Agent, or Firm*—Ronald C. Hudgens; Philip R. Cloutier; Paul J. Rose

[57] ABSTRACT

The apparatus includes an air temperature and humidity control chamber, a chopper room, strand choppers in the chopper room, a first controllable pitch fan having an inlet connected to the temperature and humidity control chamber and an outlet connected to the chopper room, a forming hood beneath the choppers, an endless conveyor chain beneath the forming hood, a chopped strand collecting chamber for collecting chopped strands which happen to pass through the conveyor chain, a suction chamber disposed beneath an upper flight of the conveyor chain and partitioned into a plurality of sections each having an inlet communicating with the forming hood through the conveyor chain and being provided with nozzle-forming downstream convergent baffle plates therein and an outlet communicating with the chopped strand collecting chamber through a duct having an adjustable damper therein securable in an adjusted position, a second controllable pitch fan having an inlet connected to the chopped strand collecting chamber and an outlet connected to the temperature and humidity control chamber, a static pressure sensor in the forming hood, and means for controlling the pitch of the fan blades in accordance with the static pressure in the forming hood.

10 Claims, 3 Drawing Figures

MAT FORMING APPARATUS

TECHNICAL FIELD

This invention relates to apparatus for making chopped glass strand mat material useful as reinforcement in plastic articles.

BACKGROUND ART

U.S. Pat. No. 2,719,336 discloses a glass strand chopper particularly useful in the production of chopped glass strand mat.

Chopped glass strand mat is usually made by drawing glass strands from wound packages on a supply creel through choppers located above a forming hood. The chopped strands are collected on a porous conveyor chain disposed beneath the forming hood and having a suction chamber disposed beneath an upper flight thereof. The suction chamber is usually divided into separate sections each attached by duct to its own fan and control damper. The control dampers are set to counterbalance the increasing thickness of the mat along the conveyor. By the attempt to balance the air flow through the different portions of the mat forming area in this manner, the chopped strands are distributed more uniformly. If the air is too dry, static electricity will cause the chopped strands to cling to the inner surface of the forming hood rather than settling on the conveyor chain. Therefore, the relative humidity is maintained at about 80% and the temperature at about 70° F. and the air is recirculated in a substantially closed system.

About 5% of the chopped strands pass through the porous conveyor chain when the strands are chopped to a length of about two inches. Before the improvements of this invention made to an existing mat forming apparatus, the strands which passed through the conveyor chain caused so much clogging to occur that the apparatus had to be shut down and cleaned as often as once every work shift. With the improvements, shutting down for cleaning out the chopped strand is now done only once a week, and operating time is increased about three hours per week. The improvements have also effected better distribution of the chopped strands and therefore mats of better quality. Further, it is now possible to make mats as light as three-fourths of an ounce per square foot. The mats can be made heavier by slowing down the conveyor. Formerly, when production was shifted from light to heavier mat, more air was admitted to the forming hood from the chopper room by increasing the area of adjustable openings between the chopper room and forming hood. This was always a matter of guessing and was not done uniformly by operators on various shifts, causing variations in mat quality.

DISCLOSURE OF INVENTION

A large glass fiber collection chamber has been provided between the suction chamber and the inlet to the temperature and humidity control chamber. A supply air fan has been installed between the temperature and humidity control chamber and the chopper room. The separate fans for each section of the suction chamber have been replaced by a pair of return air fans between the glass fiber collection chamber and the inlet to the temperature and humidity control chamber. Further, all the fans are now of the type having blades with a controllable pitch and pneumatic actuators for actuating the mechanism which changes the pitch. The control pressure to the pneumatic actuators may be adjusted manually, or may be automatically controlled by a static pressure sensor in the forming hood and a pressure receiver/controller in a control panel.

A plurality of nozzles formed by downstream convergent baffle plates have replaced a pair of relatively movable apertured flow control plates below the upper flight of the conveyor chain at the top of the suction chamber.

BRIEF DESCRIPTION OF DRAWINGS

The improved mat forming apparatus is hereinafter specifically described with reference to the accompanying drawings in which.

Figure 1:
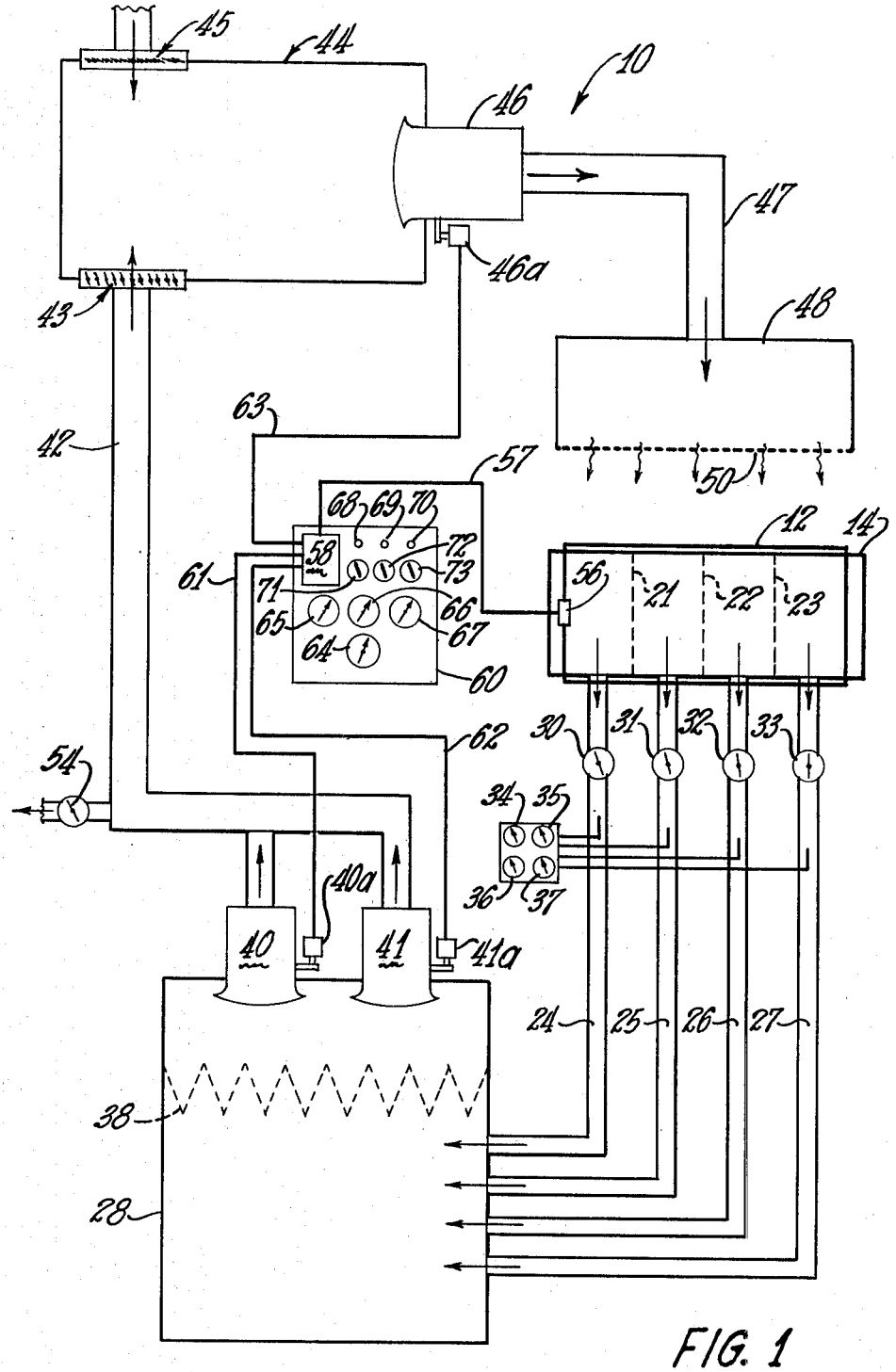
FIG. 1 is a schematic view of the improved mat forming apparatus of the invention.

With respect to the drawings, a mat forming apparatus 10 constructed in accordance with the invention is shown in FIG. 1. The apparatus 10 includes a forming hood 12 and a porous endless conveyor chain 14 shown more clearly in FIGS. 2 and 3. The conveyor chain 14 travels around four rollers 15, 16, 17, and 18 (FIG. 2), at least one of which is suitably driven to move an upper flight of the conveyor chain 14 to the right as viewed in FIG. 2.

A suction chamber 20 within the conveyor chain 14 is divided into four sections by three partitions 21, 22 and 23. The four suction chamber sections are connected respectively by ducts 24, 25, 26, and 27 (FIG. 1) to a glass fiber collection chamber 28. Dampers 30, 31, 32, and 33 are located respectively in the ducts and differential pressure gauges 34, 35, 36, and 37 are operatively connected respectively to the ducts 24, 25, 26, and 27. The dampers 30, 31, 32, and 33 are adjustable and lockable in adjusted positions.

The fiber collection chamber 28 is provided with an array 38 of filters. Two fans 40 and 41 are provided for exhausting air from the fiber collection chamber 38 and from the suction chamber 20 through the ducts 24, 25, 26, and 27. The filter array 38 is between the fans 40 and 41 and the entering points of the ducts 24, 25, 26, and 27 into the fiber collection chamber 28. The fans 40 and 41 exhaust into a duct 42 connected through normally open dampers 43 to a temperature and humidity control chamber 44. A fan 46 draws temperature and humidity controlled (e.g., 80% relative humidity at 70° F.) air from the control chamber 44 and supplies it through a duct 47 to a supply air plenum 48 having a perforated wall 50 which forms a sidewall of a chopper room 52 (FIG. 3) located above the forming hood 12.

Air may be exhausted from the duct 42 through pressure operated dampers shown as a damper 54 in FIG. 1. Fresh make-up air is admissible to the temperature and humidity control chamber 44 through normally closed dampers 45.

The fans 40, 41, and 46 are controllable pitch fans. Such fans are manufactured by Joy Mfg. Co. at the New Philadelphia Division in New Philadelphia, Ohio 44663. These fans have blades with a variable pitch or blade angle. Pneumatic actuators **40*a*, 41*a*, and 46*a* associated respectively with the fans are operatively connected respectively to blade pitch changing mechanisms. The blade pitch can be changed while the fans are in operation similarly to the pitch changing of an airplane propellor, and can be controlled either manually or automatically. Automatic operation involves the use of a static pressure sensor 56 disposed in the forming hood 12 and connected by a pneumatic tubing line 57 to a pressure controller 58 in a control panel 60. The pressure controller 58 is connected by pneumatic tubing lines 61, 62, and 63 respectively to the pneumatic actuators 40***a*, 41*a*, and 46*a* and also to an air supply (not shown). The pressure in the pneumatic lines 57, 61, 62, and 63 is connected so as to be readable respectively on gauges 64, 65, 66, and 67 in the control panel 60. Switches 68, 69, and 70 on the control panel 60 are settable in "automatic" or "manual" positions for controlling the pressure respectively to the pneumatic actuators 40*a*, 41*a*, and 46*a*. Switches 71, 72, and 73 on the control panel 60 are adjustable for manually controlling the pressure respectively to the pneumatic actuators 40*a*, 41*a*, and 46*a* when the switches 68, 69, and 70 are in "manual" position. When the switches 68, 69, and 70 are in "automatic" position, if the sensor 56 senses an increase in pressure in the forming hood 12, the pressure controller 58 will increase the pressure to the pneumatic actuators 40*a*, 41*a*, and 46*a* to increase the pitch of the blades in the fans 40, 41, 46 and thus increase the air flow, and if the sensor 56 senses a decrease in pressure in the forming hood 12, the pressure controller 58 will effect a decrease in the pitch of the fan blades. If production is shifted from light to heavier mat, it will cause an increase in pressure in the forming hood 12 and the fans 40, 41, and 46 will automatically have their blades increased in pitch to increase air flow.

Figure 2:
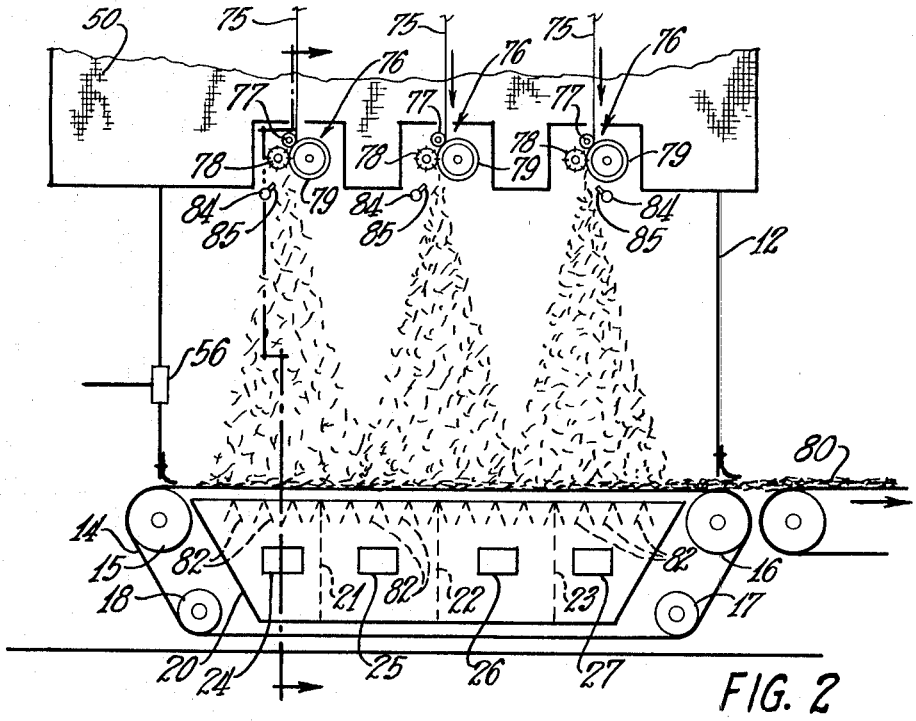
FIG. 2 is a schematic elevational view of a chopper room, forming hood, conveyor chain, and suction chamber of the apparatus of FIG. 1.
Figure 3:
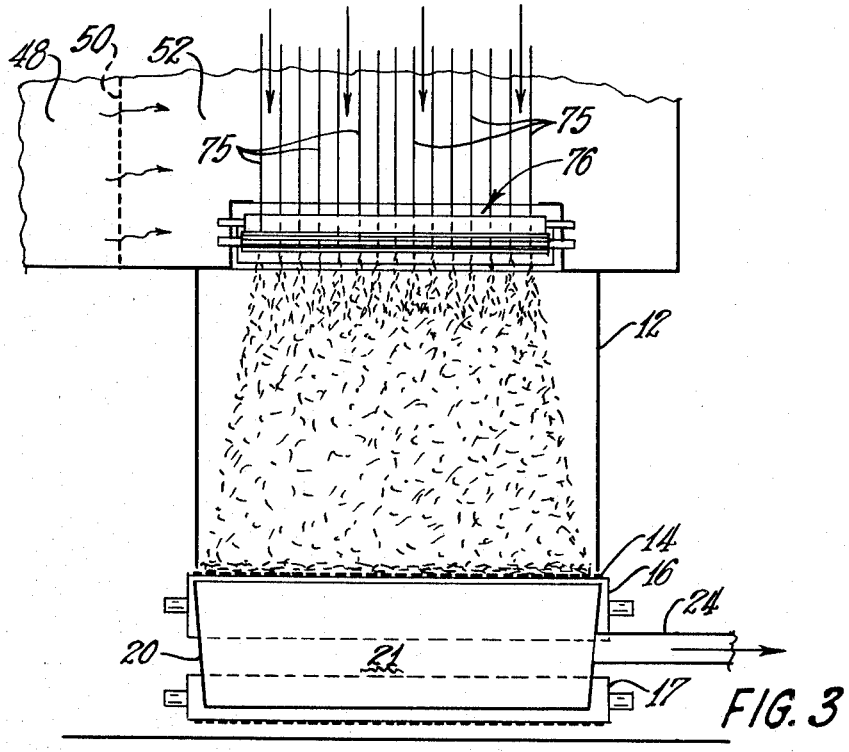
FIG. 3 is a vertical sectional view taken generally along the line 3—3 of FIG. 2.

FIGS. 2 and 3 show glass strands 75 being drawn through a plurality of suitably mounted and driven choppers 76, each including a pinch roller 77, a chopping roller 78, and a back-up roller 79. The chopped strands are accumulated on the conveyor chain 14 to form mat material 80. After the mat material 80 leaves the forming hood 12, it will pass through the usual resin bath, press rollers, curing oven, and cutter (not shown) where the cured mat is cut into pieces of a desired length.

Beneath the upper flight of the conveyor chain 14 at the top of the suction chamber 20 are a plurality of sets of downstream convergent baffle plates 82 forming nozzles for increasing air velocity. Chopped strands which pass through the conveyor chain 14 are thus better kept entrained in the air stream until they reach the collection chamber 28 and fall out. The nozzles formed by the baffle plates 82 also restrict air flow on the upstream side thereof and effect balancing of the flow velocities at various points along the forming area.

When a large number of glass strands 75 is supplied to the choppers 76 and the strands are close together, the chopped strands may have a tendency to stick together and form clumps. For this reason, a manifold 84 supplied with compressed air and provided with nozzles 85 is provided. The nozzles 85 are closely associated with the exits from the choppers and the air from the nozzles 85 breaks up any clumps of chopped strands.

With the improved mat forming apparatus, less clogging occurs and less shutting down for cleaning is required. Further, the mat quality is higher than ever before.

Various modifications may be made in the structure shown and described without departing from the spirit and scope of the invention as set forth in the following claims.

We claim:

1. A mat forming apparatus comprising an air temperature and humidity control chamber, a supply-air plenum, a first fan having an inlet connected to the temperature and humidity control chamber and an outlet connected to the supply-air plenum, a chopper room connected to the supply-air plenum, strand choppers in the chopper room, a forming hood beneath the choppers for receiving chopped strands from the choppers, an endless conveyor chain beneath the forming hood for collecting the chopped strands, forming them into a mat, and transferring the mat away from the forming hood for further processing, a chopped strand collecting chamber for collecting chopped strands which happen to pass through the conveyor chain, a suction chamber disposed beneath an upper flight of the conveyor chain and having an inlet communicating with the forming hood through the conveyor chain and an outlet communicating with the chopped strand collecting chamber, nozzle-forming downstream convergent baffle plates in the inlet of the suction chamber, a second fan having an inlet connected to the chopped strand collecting chamber and an outlet connected to the temperature and humidity control chamber, each of said first and second fans having blades which are movable to change the pitch thereof, mechanism for moving the blades to change the pitch thereof, and an actuator for operating said mechanism, a static pressure sensor associated with the forming hood for sensing the static pressure therein, and a fan blade pitch controller operatively connected to the static pressure sensor and to the actuators of each of said fans for controlling the pitch of the fan blades in accordance with the static pressure in the forming hood.

2. A mat forming apparatus as claimed in claim 1 wherein the actuators of the fans are pneumatic actuators and the controller is connected to the static pressure sensor and to the actuators of the fans by pneumatic tubing.

3. A mat forming apparatus as claimed in claim 2 including a control panel in which the fan blade pitch controller is mounted, gauges mounted in the control panel for respectively indicating the pressure in the pneumatic tubing connecting the controller to the static pressure sensor, the pressure in the pneumatic tubing connecting the controller to the actuator of the first fan, and the pressure in the pneumatic tubing connecting the controller to the actuator of the second fan, separate switches mounted in the control panel for switching the control of the blade pitch of each of the fans between manual and automatic operation, and separate manually operable means mounted in the control panel for manually controlling adjustment of the blade pitch of each of the fans when the automatic/manual switches are in the position for manual operation.

4. A mat forming apparatus as claimed in claim 1 including compressed air nozzles adjacent the exits of the choppers for breaking up clumps of chopped strands.

5. A mat forming apparatus as claimed in claim 1 wherein the suction chamber is partitioned into a plurality of sections each having an outlet communicating with the chopped strand collecting chamber through a duct having an adjustable damper therein securable in an adjusted position.

6. A mat forming apparatus as claimed in claim 1 wherein the actuators of the fans are pneumatic actuators and the controller is connected to the static pressure sensor and to the actuators of the fans by pneumatic tubing.

7. A mat forming apparatus as claimed in claim 6 including gauges for respectively indicating the pressure in the pneumatic tubing connecting the controller to the static pressure sensor, the pressure in the pneumatic tubing connecting the controller to the actuator of the first fan, and the pressure in the pneumatic tubing connecting the controller to the actuator of the second fan, switches for respectively switching the control of the blade pitch of the fans between manual and automatic operation, and manually operable means for respectively manually controlling adjustment of the blade pitch of the fans when the automatic/manual switches are in the position for manual operation.

8. A mat forming apparatus comprising an air temperature and humidity control chamber, a chopper room, strand choppers in the chopper room, a first fan having an inlet connected to the temperature and humidity control chamber and an outlet connected to the chopper room, a forming hood beneath the choppers for receiving chopped strands from the choppers, an endless conveyor chain beneath the forming hood for collecting the chopped strands, forming them into a mat, and transferring the mat away from the forming hood for further processing, a chopped strand collecting chamber for collecting chopped strands which happen to pass through the conveyor chain, a suction chamber disposed beneath an upper flight of the conveyor chain and having an inlet communicating with the forming hood through the conveyor chain and an outlet communicating with the chopped strand collecting chamber, a second fan having an inlet connected to the chopped strand collecting chamber and an outlet connected to the temperature and humidity control chamber, each of said first and second fans having blades which are movable to change the pitch thereof, mechanism for moving the blades to change the picth thereof, and an actuator for operating said mechanism, a static pressure sensor associated with the forming hood for sensing the static pressure therein, and a fan blade pitch controller operatively connected to the static pressure sensor and to the actuators of each of said fans for controlling the pitch of the fan blades in accordance with the static pressure in the forming hood.

9. A mat forming apparatus as claimed in claim 8 wherein the suction chamber is partitioned into a plurality of sections each having an outlet communicating with the chopped strand collecting chamber through a duct having an adjustable damper therein securable in an adjusted position.

10. A mat forming apparatus comprising an air temperature and humidity control chamber, a chopper room, strand choppers in the chopper room, a first fan having an inlet connected to the temperature and humidity control chamber and an outlet connected to the chopper room, a forming hood beneath the choppers for receiving chopped strands from the choppers, an endless conveyor chain beneath the forming hood for collecting the chopped strands, forming them into a mat, and transferring the mat away from the forming hood for further processing, a chopped strand collecting chamber for collecting chopped strands which happen to pass through the conveyor chain, a suction chamber disposed beneath an upper flight of the conveyor chain and partitioned into a plurality of sections each having an inlet communicating with the forming hood through the conveyor chain and being provided with nozzle-forming downstream convergent baffle plates therein and an outlet communicating with the chopped strand collecting chamber through a duct having an adjustable damper therein securable in an adjusted position, and a second fan having an inlet connected to the chopped strand collecting chamber and an outlet connected to the temperature and humidity control chamber.

* * * * *